United States Patent [19]

Merlini

[11] 4,335,864

[45] Jun. 22, 1982

[54] NEWSPAPER HOLDER

[76] Inventor: Marjorie A. Merlini, 36-1 Briarwood La., Marlboro, Mass. 01752

[21] Appl. No.: 139,461

[22] Filed: Apr. 11, 1980

[51] Int. Cl.[3] ..... A47F 5/00

[52] U.S. Cl. ..... 248/316 D; 24/259 R

[58] Field of Search ..... 248/316 R, 316 D, 316 B; 24/259 R, 260, 255 R, 252 R, 253; 211/89; 232/1 C

[56] References Cited

U.S. PATENT DOCUMENTS

| | | | |
|---|---|---|---|
| 304,692 | 9/1884 | Bingman . | |
| 1,376,753 | 5/1921 | Febrey | 211/89 UX |
| 1,704,075 | 3/1929 | Brown | 24/259 R X |
| 1,921,889 | 8/1933 | Shelton | 232/1 C |
| 2,260,584 | 10/1941 | Schuck et al. . | |
| 2,457,972 | 1/1949 | Bailey . | |
| 2,549,200 | 4/1951 | Hooks . | |
| 3,089,211 | 5/1963 | Perusse | 24/259 R |
| 3,648,334 | 3/1972 | Swaim | 24/259 R |

*Primary Examiner*—J. Franklin Foss

*Attorney, Agent, or Firm*—Blodgett & Blodgett

[57] ABSTRACT

Holder having a clip to clamp on the edge of a door and a bow for holding a newspaper or the like against the surface of the door.

5 Claims, 7 Drawing Figures

NEWSPAPER HOLDER

BACKGROUND OF THE INVENTION

Traditionally, newspaper boys have delivered their papers by dropping the newspaper outside of the principle door of the residence. Sometimes the newspaper is rolled to form an elongated package that may be easily thrown. The deposit of the rolled newspaper in front of the door subjects it to a number of hazards. A puddle of rain water may exist on the porch or a small dog may treat the newspaper as a plaything. The most depressing problem, however, is that of pilferage and this is particularly prevalent in apartment houses and in hotels, because someone may steal the newspaper even if the occupant is still in the residence. The delivery person bears the blame for the subscriber not getting a newspaper, and often must bear the cost and inconvenience of redelivery. In hotels there is not only the possibility of the newspaper being stolen, but, in those hotels where newspapers are delivered daily as a matter of courtesy, those newspapers which are not picked up by the occupant, lay around on the floor all day long where they not only present an unsightly appearance, but also interfere with the housekeeping duties, particularly with the vacuuming of the rug. These and other difficulties experienced with the prior art devices have been obviated in a novel manner by the present invention.

It is, therefore, an outstanding object of the invention to provide a holder for newspaper or the like which maintains the newspaper out of contact with the floor and/or weather conditions in front of the door.

Another object of this invention is the provision of a newspaper holder which reduces pilferage by persons passing by.

A further object of the present invention is the provision of a newspaper holder for use with a door which holder may be removed and stored between delivery times.

It is another object of the instant invention to provide a holder for newspapers which is operative on a door without damage to the finish of the door.

A still further object of the invention is the provision of a newspaper holder which renders a signal inside of the door when removal of the newspaper takes place.

It is a further object of the invention to provide a newspaper holder which is simple in construction, which is inexpensive to manufacture, and which is capable of a long life of useful service.

With these and other objects in view, as will be apparent to those skilled in the art, the invention resides in the combination of parts set forth in the specification and covered by the claims appended hereto.

SUMMARY OF THE INVENTION

In general, the invention consists of a newspaper holder for use on a door, the holder having a clip adapted to engage and grasp the edge of the door. A bow extends from the clip across the surface of the door and has an outer end that engages the surface of the door with substantial force.

More specifically, the holder is formed integrally from an elongated strip of polished stainless steel. The removal of the newspaper from the bow causes the outer end of the bow to strike the surface of the door with sufficient force to cause an audible sound. The ability of the holder to keep the newspaper off of the floor in front of the outside door eliminates much of the damage to the newspaper caused by adverse weather conditions.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
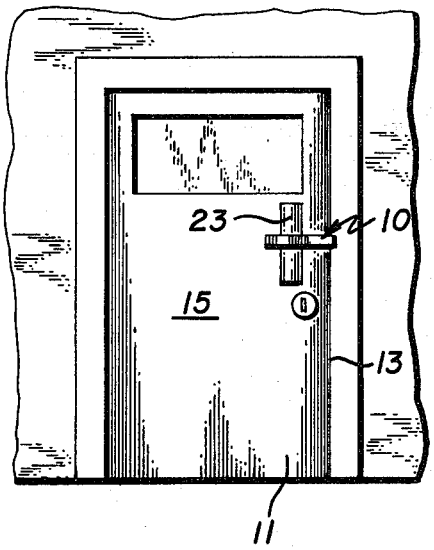
FIG. 1 is a front elevational view of the paperholder embodying the principles of the present invention in use with a door.
Figure 2:
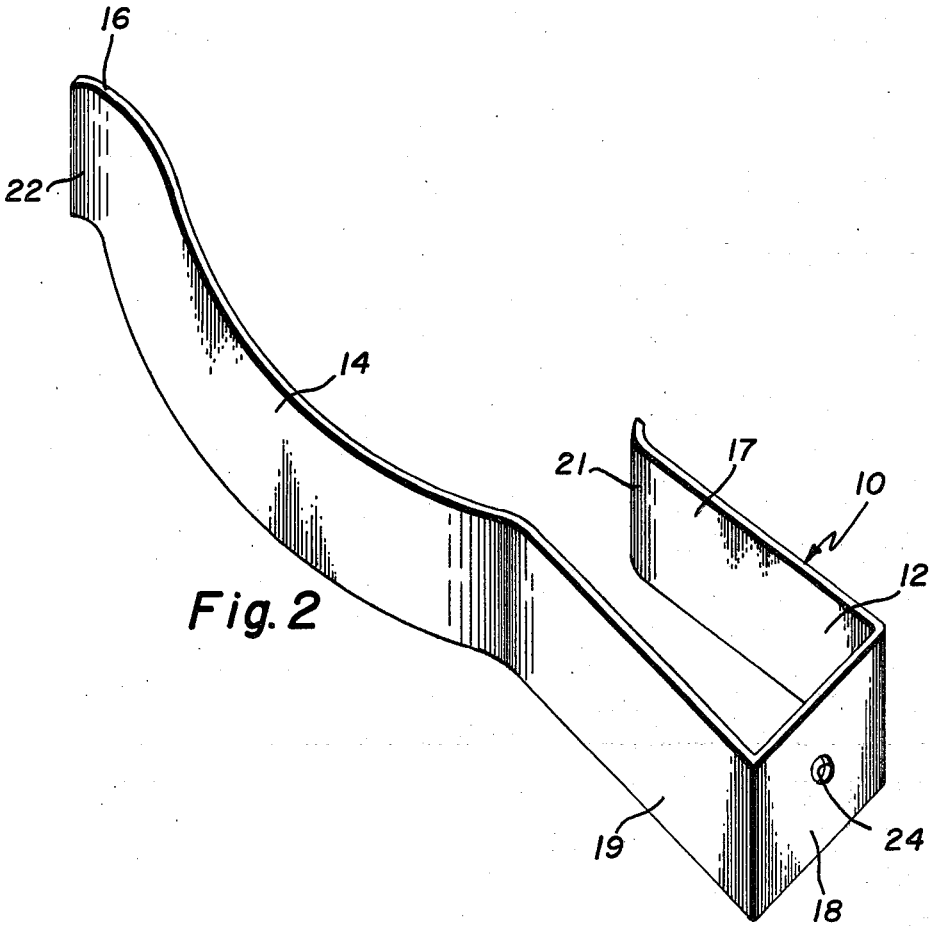
FIG. 2 is a perspective view of the holder.
Figure 3:
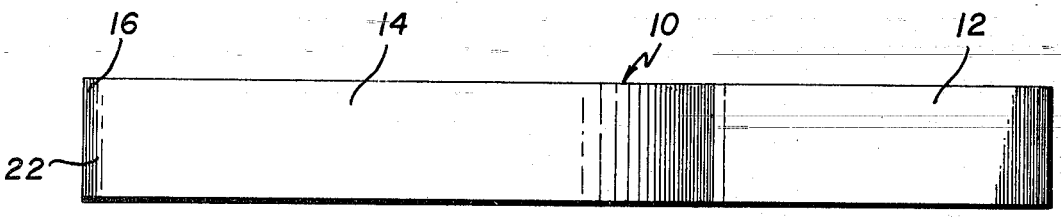
FIGS. 3–7 are a front elevational view, a rear elevational view, a top plan view, a left-side elevational view, and a right-side elevational view, respectively of the holder.
Figure 4:
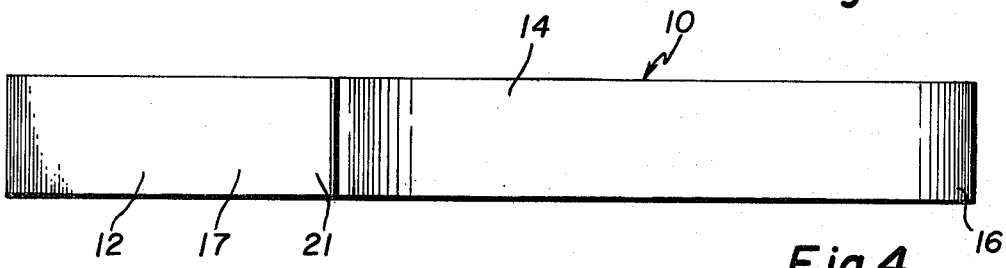
Figure 5:
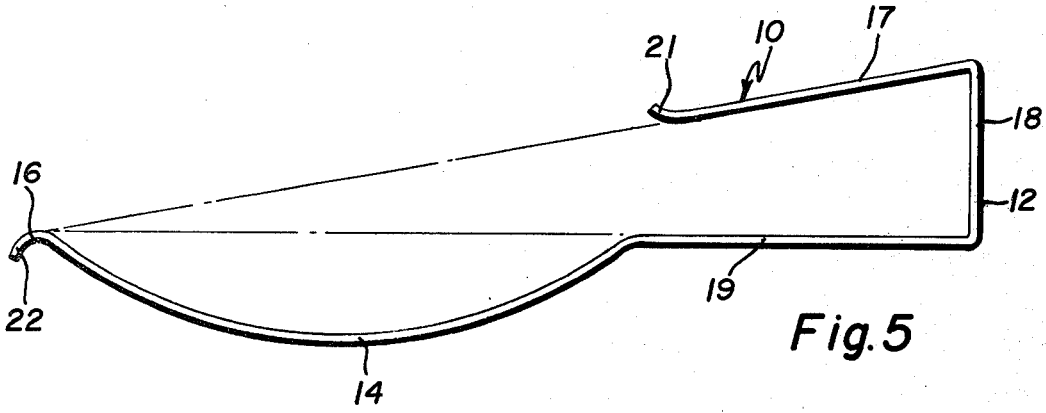
Figure 6:
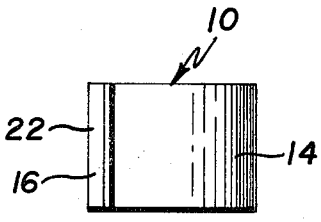
Figure 7:
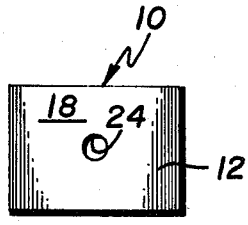

Referring first to FIG. 1, wherein are best shown the general features of the invention, the holder, indicated generally by the reference numeral 10, is shown attached to the edge 13 of the door 11. A newspaper 23 is held by the holder against the outer surface 15 of the door.

FIGS. 2–7 show the details of the newspaper holder 10. The holder is provided with a clip 12 which is adapted to engage and grip the edge of a door. The holder is also provided with a bow 14 extending from the clip across the outer surface of the door and has an outer end 16 that engages the surface of the door with substantial pressure. In the preferred embodiment, the clip is integrally formed from a single strip of polished stainless steel sheet.

The clip 12 is generally U-shaped and consists of a first leg 17 adapted to lie against the inner surface of the door, a base 18 adapted to lie flat against the edge surface of the door, and a second leg 19 adapted to lie against the outer surface of the door adjacent the edge. The free end of the first leg 17 is provided with a portion 21 which is curved outwardly to prevent damage to the surface of the door and to make it easier to slide the clip over the edge of the door. The inner surface may be provided with a thin sheet of cork to further prevent scratching of the door. The outer end 16 of the bow 14 is provided with a similar portion 22 curved away from the outer surface 15 of the door. It has been found that the clip is more effective in holding very large newspapers if portion 22 is provided with additional weight and the bow is particularly long. The first leg 17 and the second leg 19 of the clip 12 are inclined toward one another to provide a substantial clamping force when applied to the edge of the door. The second leg 19 of the clip is straight and the outer end 16 of the bow lies on an imaginary extension of the second leg, as is evident in FIG. 5. The first leg 17 of the clip is also straight and the outer end 16 of the bow also lies on an imaginary extension of the first leg. In a more expensive version, the stiffness of the second leg 19 will be reduced at the joint between the inner straight length and the bow 14 by making the material thinner or narrower at that joint. In this way, the straight length tends to stay against the door when the bow is flexed.

An aperture 24 is provided through the center of the base 18 of the clip to facilitate storage of the holder when it is not in use. As is best evident in FIG. 5, the bow 14 is bent in the form of an arc of a circle. The aperture may also be used with a screw or other fastener to semi-permanently attach the clip to the door without defacing either the inner or outer surface of the door.

The operation and advantages of the present invention wil now be readily understood in view of the above description. It is contemplated that the holder would normally be stored in the interior of the residence, possibly by being hung on a hook on the inner surface of the door. It could, of course, be used permanently by making use of the aperture 24 to mount the clamp on the edge of the door by means of a screw. In either case. The holder is applied to the edge of the door and, once it has been so applied, the newspaper boy can slip the newspaper into the bow 14, preferably in a vertical position, as shown in FIG. 1. When the occupant of the residence opens the door, he is able to lift the newspaper out of the holder very easily. If, however, anyone attempts to remove the newspaper, the outer end 16 with its curved portion 22 will, because of the resilience of the bow 14, be caused to strike the surface 15 of the door. Because of the construction of doors in general, any slight noise of this type will be clearly heard in the interior of the residence and the occupant will be warned of the attempted stealing of the newspaper.

Thus, it can be seen that not only will the newspaper be held in a high position away from the floor and weather hazards and will have a respectable appearance, but the possibility of pilferage or damage by weather is substantially reduced. Because of the rugged nature of the holder in general, it has a long life. When the door is closed the holder itself cannot be stolen, because of the manner in which the clip surrounds the edge of the door. Nevertheless, the holder does not mar the appearance of the door in any way and, as a matter of fact, it is contemplated that the holder could be removed from the door at all times except during newspaper delivery times. The absence of the holder might be a signal that the newspaper is not desired.

It is contemplated that the device will be produced in a number of different sizes to fit different thicknesses of door and to hold different sizes of newspaper.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Newspaper holder for use on a door, comprising:

(a) a generally U-shaped clip consisting of a first leg, adapted to lie against the inner surface of the door, a base adapted to lie against the edge surface of the door, and a second leg adapted to lie against the outer surface of the door, the legs of the clip converging toward one another away from the base to provide a substantial clamping force when applied to the edge of the door, and (b) a bow extending from the clip across the surface of the door and having an outer end that engages the surface of the door with substantial pressure, the clip and the bow being integrally formed from a single strip of material, the free end of the first leg being provided with a portion bent outwardly to prevent damage to the surface of the door and the free end of the bow being provided with a similar portion curved away from the surface of the door, being formed in the base of the clip to enable the holder to be fixed to the end of the door and facilitate storage of the holder when it is not in use.

2. Newspaper holder as recited in claim 1, wherein the material is polished stainless steel and the removal of a newspaper from the bow causes the outer end of the bow to strike the surface of the door with sufficient force to cause an audible sound.

3. Newspaper holder as recited in claim 1, wherein the second leg of the clip is straight and the outer end of the bow lies on an imaginary extension of the second leg.

4. Newspaper holder as recited in claim 3, wherein the first leg of the clip is straight and the outer end of the bow lies on an imaginary extension of the first leg.

5. Newspaper holder is recited in claim 1, wherein the bow is bent in the form of an arc of a circle.

* * * * *